73-151 SR
9/6/77 OR 4,046,006

United States Patent [19] [11] 4,046,006
Dufrene [45] Sept. 6, 1977

[54] TUBING PLUG APPARATUS FOR PERFORMING DOWN-HOLE PRESSURE TESTS

[76] Inventor: Alex Dufrene, P.O. Drawer D, Des Allemands, La.

[21] Appl. No.: 594,331

[22] Filed: July 9, 1975

[51] Int. Cl.[2] ..... E21B 47/10
[52] U.S. Cl. ..... 73/151
[58] Field of Search ..... 73/151, 49.5, 49.6

[56] References Cited

U.S. PATENT DOCUMENTS

| | | | |
|---|---|---|---|
| 2,216,268 | 10/1940 | Fritsche | 73/151 |
| 2,653,474 | 9/1953 | Santiago | 73/151 |
| 2,731,827 | 1/1956 | Loomis | 73/151 |
| 3,152,639 | 10/1964 | Pearcy | 73/151 |

*Primary Examiner*—James J. Gill
*Assistant Examiner*—Anthony V. Ciarlante
*Attorney, Agent, or Firm*—Donald Gunn

[57] ABSTRACT

A tubing pressure test apparatus which comprises an elongate hollow body is disclosed. A fishing neck on a sliding mandrel carrying a check valve on the bottom end is received an upper outer hollow mandrel which has an internal valve seat. Fluid communication from the exterior of the mandrel to an internal passage is controlled by the check valve on the upper mandrel. The check valve is received in the seat below lateral passages to the exterior. The axial internal passage communicates through the bottom of the tool to enable the tool to be pulled upwardly in the tubing string through a column of liquid. The upper outer mandrel is threaded to a central pipe which supports an expandable resilient element. The pipe is slidably connected to an outer lower mandrel which has a taper which forces the expandable element radially outwardly when a compressive force is applied to the top of the tool. The lower end of the tool carries a collar locator which includes a pair of spring located radially outwardly directed contoured fingers which resiliently deflect outwardly in order to latch into a collar. At this juncture, sinker bars bearing on the top of the tool in the running string cause it to compress, thereby expanding the resilient element and closing the fluid path through the tool. This enables a pressure test to be run above the tool. The tool is then pulled upwardly to another elevation to run a subsequent test.

9 Claims, 2 Drawing Figures

TUBING PLUG APPARATUS FOR PERFORMING DOWN-HOLE PRESSURE TESTS

BACKGROUND OF THE INVENTION

In flowing wells, the production is delivered from the formation to the surface through a tubing string. Tubing strings are normally fluid isolated from the well itself. This is to avoid communication of one geological formation to another. The integrity of the tubing string is quite important. After a period of time, small leaks may develop in the tubing string. One or more leaks will hamper production of the well and may create severe problems. The present invention is a pressure test apparatus which enables selected portions of the tubing string to be closed off and a pressure test run on the tubing thereabove.

Pressure testing of tubing strings is a preventive maintenance step which protects against catastrophic growth of leaks in a tubing string. For example, several tubing strings may be placed in a single well to communicate with different pay zones. The present invention enables testing of a tubing string at different horizons. Suppose, for example, that a tubing string is 10,000 feet long and communicates with a bottom hole zone of high pressure. It passes through two low pressure zones. Assume the well includes separate tubing strings to the low pressure zones which are isolated by suitable packer elements. Pressure from the 10,000 foot string leaked into the well may substantially cut production. However, a leak in the near vicinity of the low pressure zones will not only cut production from the high pressure zone, but the pressure may in fact overcome the low pressure zone fluid drive and reduce production from that zone almost to zero. The present invention is able to be run in a tubing string to pressure test the string. It is lowered in a string to a specified elevation. At the lowermost elevation, the device is landed at a collar and the pressure is tested. Leaks in the tubing string are indicated by failure of the string to maintain an adequate pressure level. If leaks are found, the tool is then moved up to different elevations in the string and additional tests are run. If the pressure is not held for a period of time, a leak above the tool is again indicated. The joint of tubing which leaks can thus be located by successive tests. The apparatus of the present invention can be used to take multiple readings so that pressure retention of the tubing string is observed. The rate of drop of pressure during a retention test and the depth of the tool in the string can be used to locate and estimate the size of a leak, thereby enabling repairs to the tubing string.

SUMMARY OF THE INVENTION

The present invention is a pressure test apparatus for use in testing a tubing string for pressure retention at various elevations. The apparatus includes a fishing neck which enables it to be connected to a set of sinker bars to enable it to be run down-hole. The fishing neck is attached to an upper mandrel which terminates at a value element. The valve element is captured internally of an upper outer mandrel which has an internal valve seat. The mandrel is hollow through its length to enable the valve element to slide within certain limits. Lateral openings through the upper outer mandrel communicate fluid from the exterior to the valve seat which, when open, communicates through a pipe and along the length of the tool on the interior. The pipe supports an expandable resilient element. It is preferably formed of an elongate resilient sleeve. The pipe is slidable with respect to an outer lower mandrel. The outer lower mandrel has a tapered upper edge which forces its way under the resilient element and expands it radially outwardly to plug the tubing string. Expansion of the resilient element is dependent on compression of the tool. The lower end of the tool is held in a collar by means of a bifurcated collar finder which locks into a collar on relatively downward movement. This stabilizes the lower end of the tool, enabling weight on the upper end of the tool to compress it, thereby expanding the resilient element and additionally closing the check valve in the apparatus to prevent further fluid flow. This completely plugs the tubing string and enables a pressure test to be run in the tubing above the present invention. It is moved upwardly by a simple pull which opens the check valve means to relieve pressure built up above the tool. An upward pull also releases the collar lock.

DESCRIPTION OF THE PREFERRED EMBODIMENT

Figure 1A:
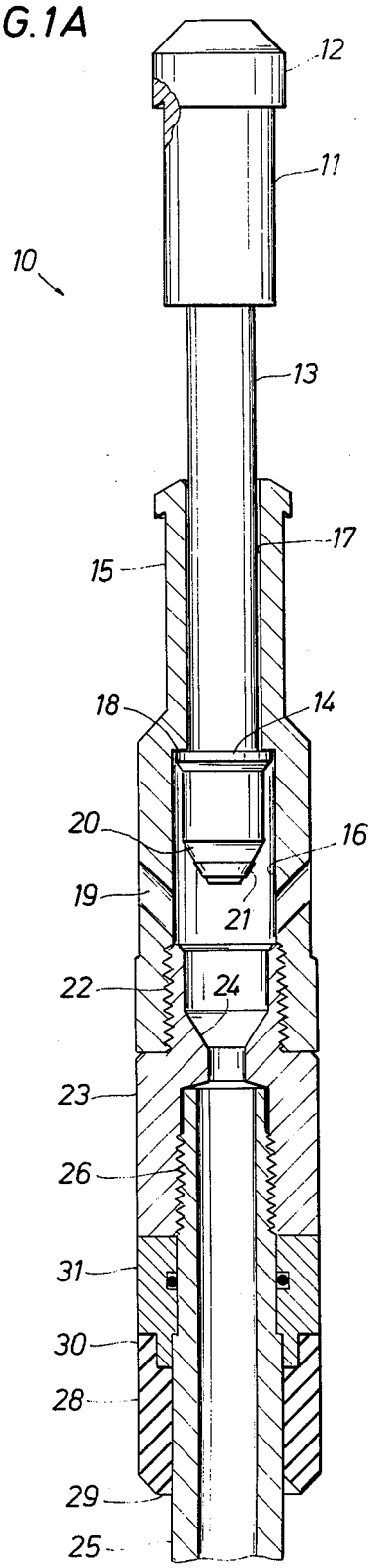
FIGS. 1A and 1B together show the present invention in an elongate sectional view along a diameter and disclose details of construction.

The oil tool 10 includes an upper mandrel 11 which incorporates a standard API fishing neck 12 at the upper end. The mandrel 11 has an elongate smaller diameter portion 13 which terminates at an enlarged shoulder 14. The shoulder 14 limits upward travel of the mandrel 11. An upper outer mandrel 15 encircles and receives the mandrel 11. The mandrel 15 has an axial passage which terminates at a chamber 16. The chamber 16 is concentric with and slightly larger than the axial passage 17. The axial passages 16 and 17 connect at a transverse shoulder 18 which abuts the enlargement 14 on the mandrel 11, thereby limiting its range of upward movement.

The mandrel 15 has lateral passages 19 which open to the chamber 16. The chamber 16 is in fluid communication with the fluids in the tubing string above the tool.

The mandrel 11 incorporates a tapered conic point 20 at its lower end. A seal member 21 is placed on the taper 20 and cooperates to form a check valve. The mandrel 15 is threadedly connected at 22 to a sub 23. The sub 23 is axially drilled at its upper end to provide an extension to the chamber 16. The axial passage is tapered at 24 to define a valve seat for the valve element on the lower end of the mandrel 11. The valve seat 24 is contoured in size to close the axial passage through the tool when the valve element 20 is forced downwardly against the valve seat. The sub 23 is also threaded to a pipe 25. The interconnection is at a set of threads 26. The pipe 25 continues the axial passage through the tool, which begins with the lateral passages 19.

The pipe supports a resilient element 28 on its exterior. The resilient element is in the form of an elongate sleeve. The resilient sleeve 28 is fairly thick. It has a lower shoulder 29 and an upper shoulder portion 30. The upper shoulder 30 is abutted against a sleeve lock member 31. The sleeve lock member 31 is captured on the exterior of the pipe 25 so that it may not slide. The lock member 31 has an undercut shoulder to define a step which supports and holds the sleeve 28. The upper end of the sleeve 28 is intended to remain stationary and does not slide.

Figure 1B:
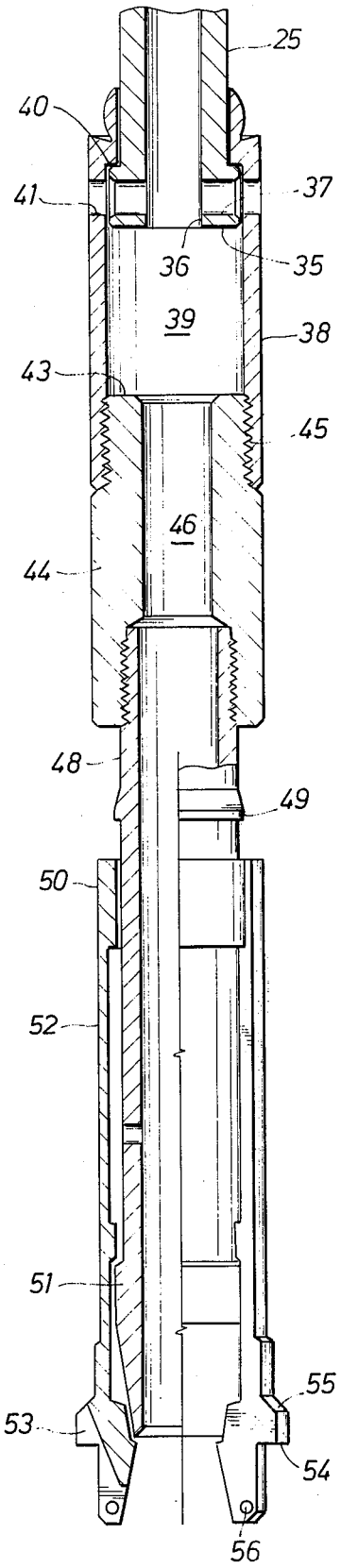

In FIG. 1B, the pipe 25 terminates in an enlargement 35 which has a central bottom opening 36 and lateral ports 37. The enlargement 35 is captured in a lower outer mandrel 38. The lower outer mandrel 38 defines an internal chamber 39. The chamber 39 permits lengthwise movement of the enlargement 35 within limits. The upper limit is defined by a shoulder 40. When the tool is elongated by pulling the pipe 25 upwardly, the enlargement 35 is limited in travel at the shoulder 40. In that position, the lateral passage 37 is aligned with an external opening 41 which provides pressure relief through the tool. This is helpful in pulling the tool upwardly in a tubing string filled with liquid. It is immaterial whether the flow in the tubing string is through the axial passage or on the exterior.

The chamber 39 is defined at its lower end by an abutting shoulder 43. The shoulder 43 is the upper end of a lower sub 44. The sub 44 is joined to the outer lower mandrel 38 at a threaded connection 45. The sub 44 incorporates an axial passage 46 along its length.

The sub 44 is theaded to an elongate hollow member 48 which comprises a portion of the collar lock mechanism. The collar lock mechanism is a bought item which can be obtained from any sources. The collar lock mechanism includes the hollow member 48 which is hollow through its length to complete the fluid communication path through the tool 10 of the present invention. It includes a shoulder 49 which limits travel of an encircling collar 50. The collar 50 is slidably received on the exterior with its upper travel limited by the shoulder 49. Its lower travel is limited by a similar shoulder 51. The collar 50 supports a pair of facing fingers 52. They are elongate and are adapted to flex inwardly and outwardly. Two fingers are adequate, but three or four can be incorporated if desired. The fingers are profiled at the lower end. An outwardly protruding contour 53 is adapted to fit between the ends of joints of tubing adjacent to a collar. The contour 53 latches into the space adjacent to a collar. It is spring loaded outwardly to be forced into the space. The profile 53 terminates at a lower transverse shoulder 54. It is not possible for the shoulder 54 to ride over the top end of a tubing joint adjacent to a collar. By contrast, a tapered shoulder 55 on the upper end of the profile is able to ride over the tubing shoulder at a collar. The fingers include at their lower ends openings 56. They enable the fingers to be tied or pulled together. When running the tool down-hole before operation, the fingers are preferably pulled together or tied. When they are tied together, they are pulled inwardly and are not able to deflect outwardly and thereby lock into a collar. When they are free to flex, however, flexure is controlled and limited by the position of the fingers relative to the tubing member 48.

The collar 50 is free to slide lengthwise on the tubing member 48. In the up position of FIG. 1B, inward flexure is forbidden. This results from the shape or contour of the hollow member 48. It limits radially inward flexure of the fingers. However, the apparatus is able to find a collar in the tubing string when the fingers are extended below the position of FIG. 1B. The fingers 52 are moved laterally downwardly and away from the tubing 48. The exterior of the tubing is profiled to prevent inward deflection. In the extended finger position, they are free to deflect. As the tool is pulled upwardly in the tubing string, they deflect noticeably on passing each collar. This deflection in the pulling equipment can be felt by a surface operator. When the tool is pulled upwardly past an elevation of interest, it is then lowered downwardly because it normally is weighted. A downward push on the tool forces the collar 50 upwardly on the tubing member 48. When this occurs, the fingers 52 are then moved adjacent to the lower end of the tubing member 48. This limits their inward deflection and causes the apparatus to lock into the next collar. The fingers 52 deflect outwardly and the profiled protrusions 53 engage the collar between adjacent joints and the lower end of the tool is locked relative to that location. The tool is then set for a pressure test. Weight above the tool is applied to the tool, thereby forcing the upper mandrel 11 downwardly. This closes the fluid path through the tool by engaging the valve member 20 in the valve seat 24. The weight compresses the tool by forcing the pipe 25 downwardly. This causes the resilient sleeve 28 to expand. It expands by forcing the tapered upper end of the outer lower mandrel 38 beneath the sleeve. This expands the resilient element and closes the exterior of the tool, creating a complete pressure seal across the tubing string and thereby closing the tubing for pressure test.

After testing, the tool is released by an upward pull. The upward pull first disengages the valve permitting fluid communication. It pulls the pipe 25 upwardly and carries the resilient sleeve upwardly and away from the tapered surface which forces it outwardly. This restores the resilient sleeve 28 to the illustrated dimensions and opens the exterior of the tool to fluid communication in the tubing string. Additional upward pull on the tool pulls the tubing 48 up from the fingers 52. When the shoulder 51 moves upwardly relative to the collar 50 and abuts it, then the fingers are pulled free. The fingers are freed to deflect inwardly and thereby disengage that particular collar. The tool is then pulled upwardly in the tubing string to another location for subsequent testing or removal from the well.

The foregoing is directed to the preferred embodiment of the present invention. The scope is determined by the claims which follow.

I claim:

1. A tubing pressure test apparatus comprising:

an elongate body having a fishing neck adapted to be grasped by a wire line tool and which fishing neck is relatively movable with respect to said elongate body and further including a cooperative valve element in a valve seat means movable between open and closed positions by operation of said fishing neck and which valve element controllably opens and closes the flow of well fluids through a passage through said elongate body;

an expandable element carried by said body and expanded radially outwardly toward a surrounding tubing string to close a tubing string to fluid flow therethrough;

expander means at least indirectly supported on said body for expanding said element radially outwardly toward a surrounding tubing string by compressing said element, said means being selectively operated by weight acting on the tubing pressure test apparatus; and lock means adapted to secure the tubing pressure apparatus at a selected and specified elevation in a tubing string to enable weight acting on the tubing pressure test apparatus to operate said expander means.

2. The apparatus of claim 1 including an axial passage through said body, and a weight actuated valve in said passage to close said passage to fluid flow therethrough.

3. The apparatus of claim 2 wherein said lock means includes a collar profiled lock shoulder on a set of extended deflectable collet fingers and said body includes an elongate surface movable relative to said fingers which locks and releases said fingers to enable said lock means to be set in a collar in the tubing string.

4. The apparatus of claim 1 including an elongate slidable flowpipe in said body which telescopes into a lower body portion and wherein said expandable element is carried on said flow pipe toward said lower body portion which incorporates a means acting cooperatively on movement to expand said expandable portion wherein said expansion occurs on downward movement of said stem.

5. The apparatus of claim 4 wherein said lock means cooperates with said lower body portion to achieve locking on downward movement thereof into a collar locating and locking position and releases therefrom on upward movement of said stem.

6. The apparatus of claim 5 wherein said lock means includes said flexible collar locating fingers which are locked in position by said lower body portion and released thereby on upward movement.

7. The apparatus of claim 5 wherein said lower body portion includes a fluid passage outlet connected with said flow pipe.

8. The apparatus of claim 7 wherein said lower body portion has an axial drilled passage and an encircling collar of constricted construction which slidably receives said flow pipe therethrough for limited axial movement.

9. A tubing pressure test apparatus comprising:

an elongate body including a connection means at the upper end thereof for enabling said elongate body to be lowered into a tubing string;

an expandable element carried by said body and expanded radially outwardly toward a surrounding tubing string to close a tubing string to fluid flow therethrough expander means at least indirectly supported on said body for expanding said element radially outwardly toward a surrounding tubing string by compressing said element, said means being slectively operated by weight acting on the tubing pressure test apparatus;

lock means comprising a collar profiled lock shoulder on a set of extended deflectable collet fingers, and an elongate surface on said body movable relative to said fingers which locks and releases said fingers to enable said locking means to be set in a collar in the tubing string when weight acting on said test apparatus operates said expander means;

and wherein said body includes an axial passage having an upper opening;

an axial passage having an upper opening;

a valve seat in said passage;

a valve element for closing said passage by closing against said valve seat; and, a stem connecting to said valve element and extending toward the upper end of said body and exposed to enable said stem to be connected to a means for pulling upwardly and downwardly to achieve controlled closure of said passage by said valve element.

* * * * *